US005110180A

United States Patent [19]

Schneider

[11] Patent Number: 5,110,180

[45] Date of Patent: May 5, 1992

[54] CONVERTIBLE CHAIR-BED FOR INDOOR AND OUTDOOR USE

[76] Inventor: Rudolf T. Schneider, von Galen-Strasse 8, DE-6400 Fulda, Fed. Rep. of Germany

[21] Appl. No.: 432,738

[22] PCT Filed: Apr. 15, 1988

[86] PCT No.: PCT/EP88/00324

§ 371 Date: Oct. 11, 1989

§ 102(e) Date: Oct. 11, 1989

[87] PCT Pub. No.: WO88/07827

PCT Pub. Date: Oct. 20, 1988

[30] Foreign Application Priority Data

Apr. 16, 1987 [DE] Fed. Rep. of Germany ..... 3713117

Oct. 20, 1987 [DE] Fed. Rep. of Germany ..... 3735498

[51] Int. Cl.[5] ..... A47C 1/02

[52] U.S. Cl. ..... 297/78; 297/19; 297/39

[58] Field of Search ..... 297/78, 80, 81, 82, 297/19, 21, 22, 29, 30, 38, 39, 40, 377

[56] References Cited

U.S. PATENT DOCUMENTS

| | | | |
|---|---|---|---|
| 1,185,181 | 5/1916 | Collins | 297/377 X |
| 2,047,178 | 7/1936 | DeConinck | 297/19 |
| 2,507,023 | 5/1950 | Lee | 297/19 |
| 2,701,603 | 2/1955 | Coopersmith | 297/19 |
| 2,964,099 | 12/1960 | Panicci | 297/39 X |
| 3,031,228 | 4/1962 | Tydor | 297/39 X |

FOREIGN PATENT DOCUMENTS

| | | | |
|---|---|---|---|
| 1225062 | 6/1960 | France | 297/38 |
| 183377 | 3/1936 | Switzerland | 297/22 |
| 1030933 | 5/1966 | United Kingdom | 297/377 |

*Primary Examiner*—José V. Chen

*Attorney, Agent, or Firm*—Nixon & Vanderhye

[57] ABSTRACT

A chair-bed allows a person to sit comfortably and to stretch out in a recumbent position; it can be folded together to be flat and easily transported, provided that in the frame parts of the back rest (5), the seat (6) and the leg rest (7), the following conditions are fulfilled: $a+b>c+d$, $e+f>g+h$, where a is the distance between the points (11) and (3), b is the distance between the joints (3) and (10), c is the distance between the joints (10) and (8), d is the distance between the joints (8) and (11), e is the distance between the joints (23) and (22), f is the distance between the joints (11) and (9) and h is the distance between the joints (9) and (23).

20 Claims, 4 Drawing Sheets

CONVERTIBLE CHAIR-BED FOR INDOOR AND OUTDOOR USE

The invention concerns a convertible chair-bed for indoor and outdoor use, whose elements consist of frames connected by joints and which may be brought from chair into bed position and vice versa by changing their position relative to each other.

It is known that there are a number of folding chairs for comfortable sitting and whose sitting position is adjustable, but not to the extent that the normal sitting position is turned into a fully horizontal reclining position.

There are also various pool lounges with a horizontal reclining surface and adjustable head and leg parts which, however, cannot be adjusted to the extent that a comfortable sitting position is obtained.

This is primarily a consequence of the seat height being too low.

Although a chair-bed is known from DE-A 34 17 283 which enables a normal sitting and reclining position, it is unsuitable for simple use as a beach or pool lounge because of the complicated mechanics, the many frame parts connected by joints, and particularly because of its heavy weight. Because of the many joints and frame parts, jamming while changing positions cannot be ruled out. In particular, this chair-bed cannot be folded completely flat for transport, for example, in a car trunk, and no intermediate positions are possible.

The invention has the objective of creating a chair-bed of the type mentioned which permits comfortable sitting as well as reclining. The chair-bed should also be easy to set up. Finally, it should be possible to fold it flat and to transport it easily.

The task is solved according to the invention through the characteristics of Claim 1. Useful types of the invention are reflected in the secondary claims.

The chair-bed according to the invention is easily set up and adjusted between sitting and completely horizontal reclining positions. This may be considered altogether amazing due to its rather simple construction since the customary pieces of furniture which are adjustable from sitting to reclining positions either have a very complicated and excessive construction making them hard to handle, or the adaptation of a chair to a completely horizontal lounge was unthinkable.

Figure 1:
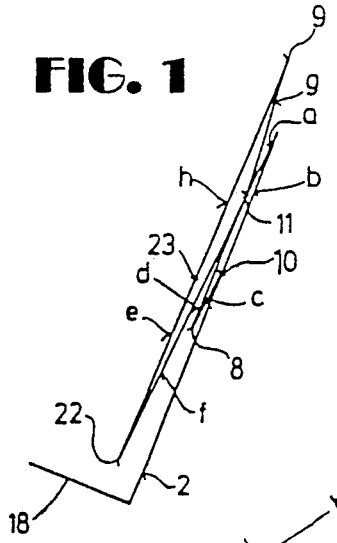
Figure 2:
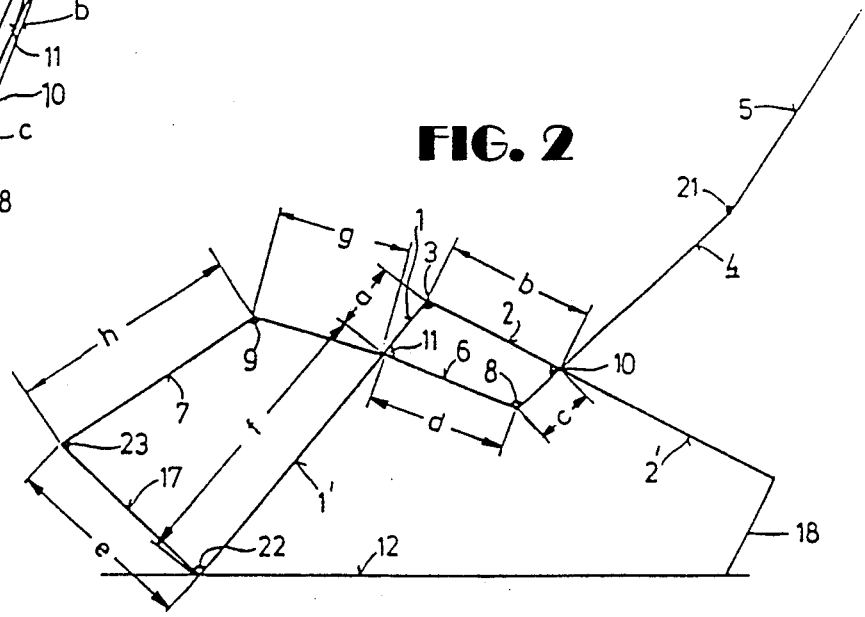
Figure 3:
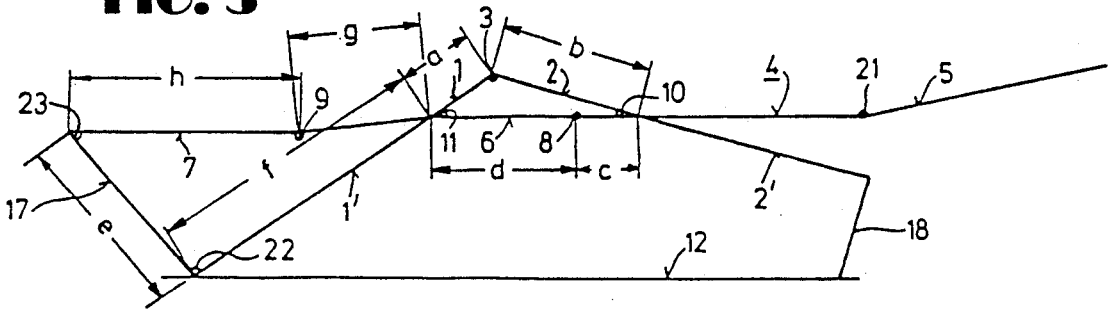
Figure 6:
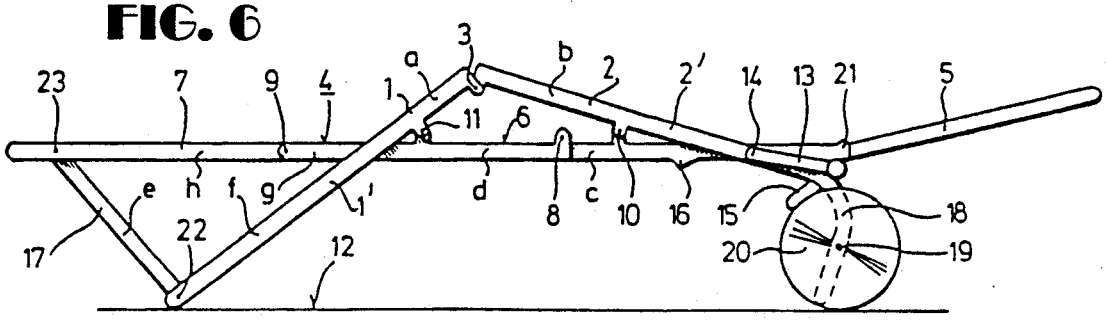
Figure 4:
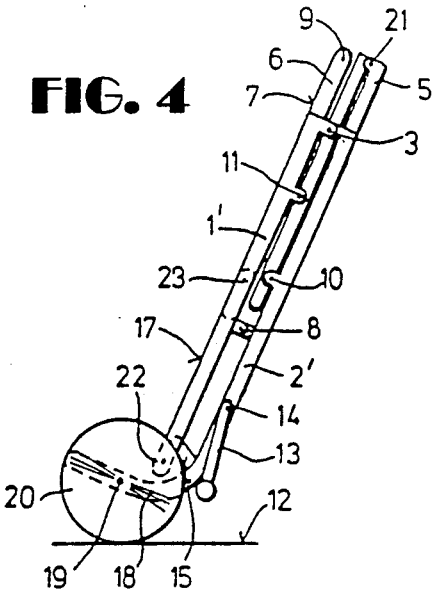
Figure 7:
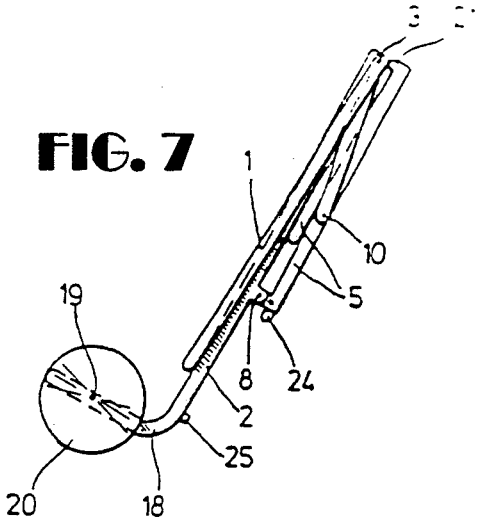
Figure 5:
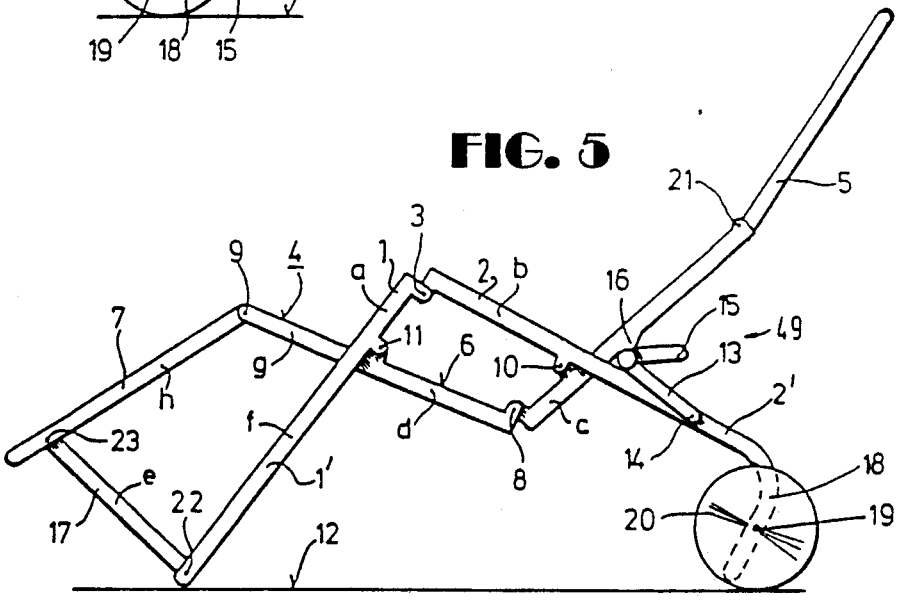
Figure 8:
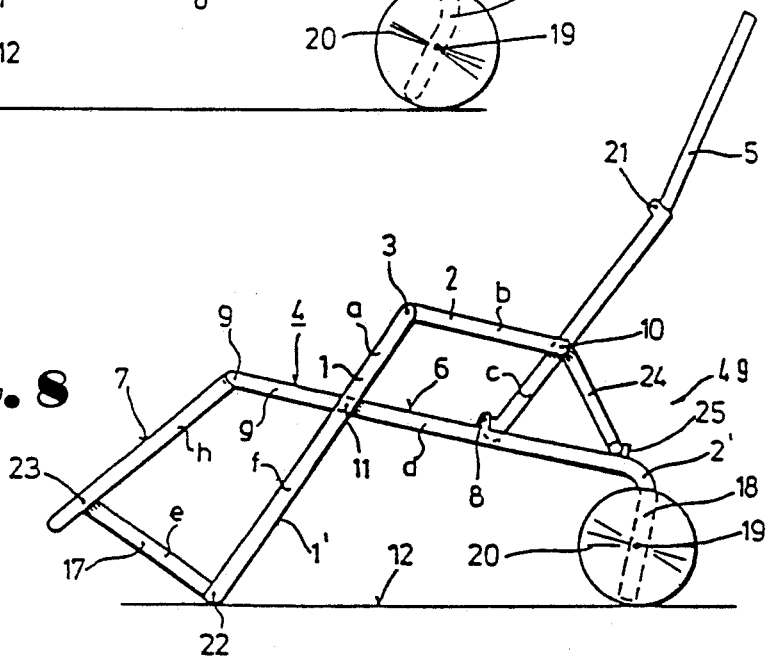
Figure 9:
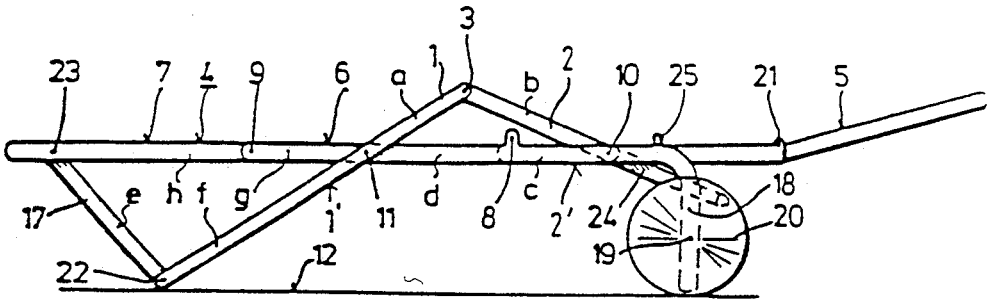
Figure 10:
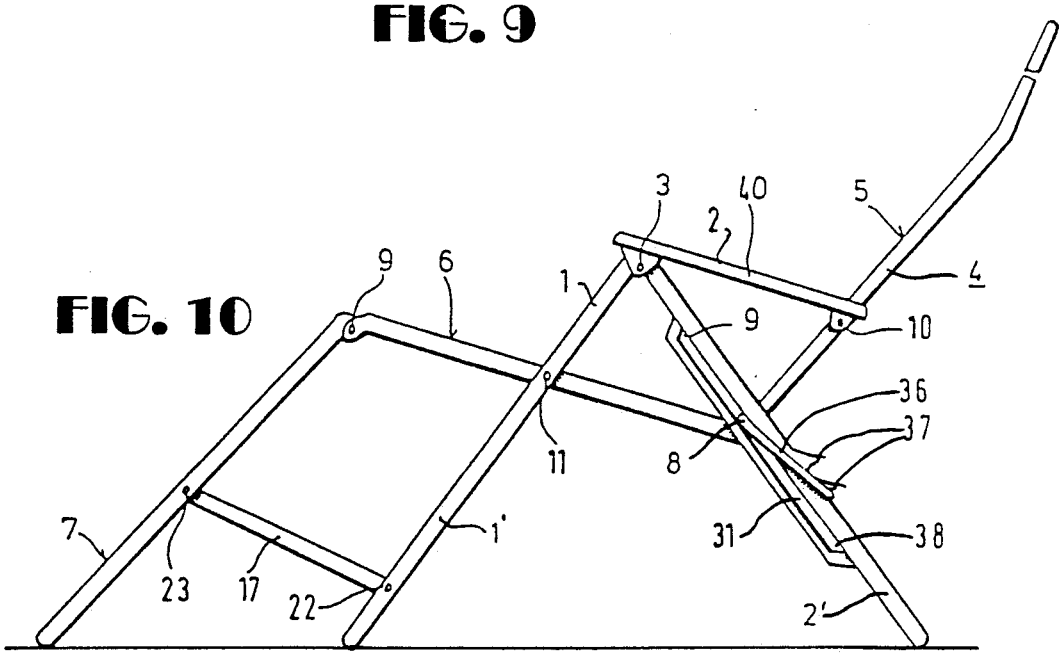
Figure 13:
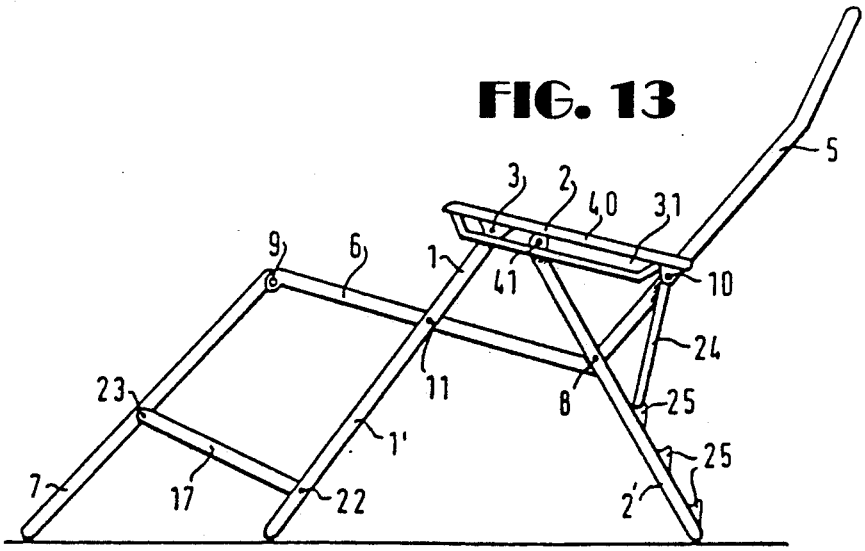
Figure 11:
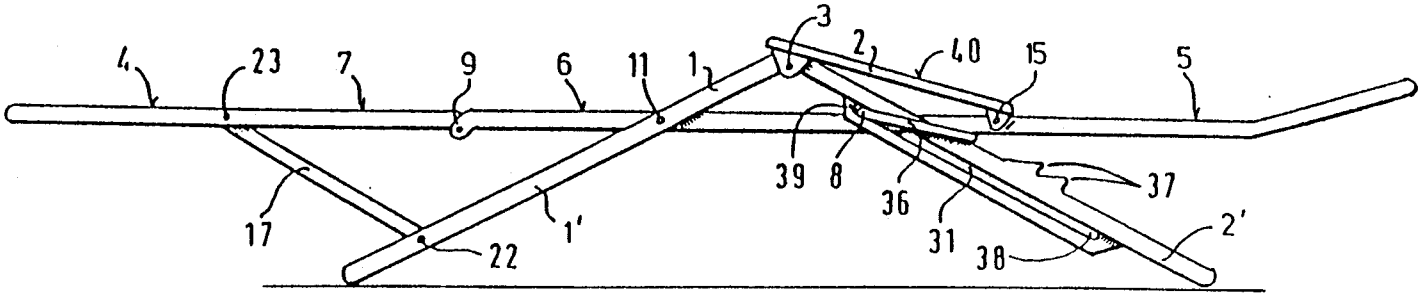
Figure 14:
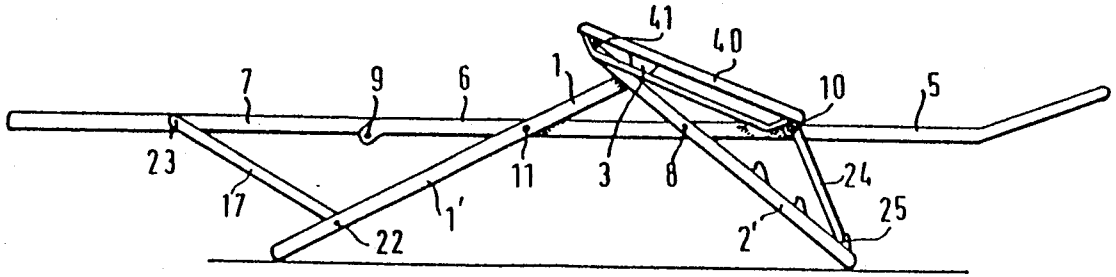
Figure 15:
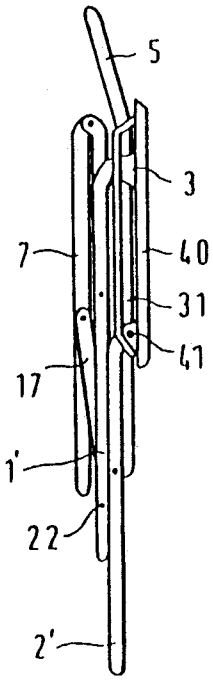
Figure 12:
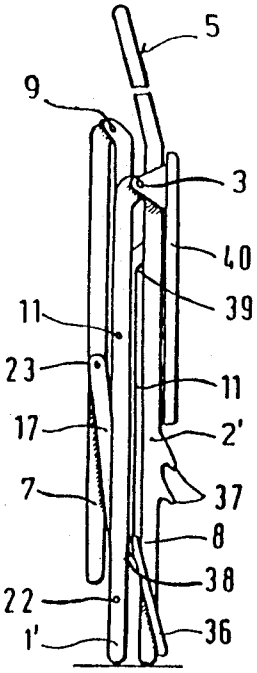

Other advantages, details and characteristics of the invention originate from the examples shown in more detail in the following drawings. Shown are in detail:

FIG. 1: the kinematics of a primary example of a chair-bed based on the invention in its folded state (schematic lateral view);

FIG. 2: schematic lateral view according to FIG. 1 of the chair-bed based on the invention in its unfolded state for the sitting position;

FIG. 3: another portrayal of the example according to FIGS. 1 and 2 in the schematic lateral view set up in the reclining position;

FIG. 4: a more detailed portrayal of the folded chair-bed in the lateral view;

FIG. 5: the chair-bed in the lateral view in the sitting position;

FIG. 6: condition of the chair-bed in the reclining position;

FIG. 7: another example of the chair-bed in the lateral view;

FIG. 8: the chair-bed according to FIG. 7 in the sitting position (lateral view);

FIG. 9: the chair-bed according to FIGS. 7 and 8 in the reclining position (lateral view);

FIG. 10: lateral view of another example in the sitting position;

FIG. 11: the chair-bed according to FIG. 10 in the reclining position (lateral view);

FIG. 12: lateral view of the folded chair-bed according to FIGS. 10 and 11;

FIG. 13: another portrayal of an example in the sitting position;

FIG. 14: the chair-bed shown in FIG. 13 in the horizontal reclining position (lateral view);

FIG. 15: lateral view of the folded chair-bed according to the last example.

FIGS. 1 to 3 show in a simplified drawing the lateral view of the change from folded chair-bed to chair, and then to lounge.

Here the chair-bed consists of front and back supports 1 and 2 i.e., first and second supports 1 and 2, which serve simultaneously as seat and back frame supports 1' and 2', respectively, and are connected to each other via an upper or first joint 3, a sitting and reclining surface 4 which in the shown example has four parts consisting of a two-part, hinged backrest 5, a seat 6 and a leg rest 7 whereby the backrest 5 is connected with the seat 6 by a second joint 8 and the seat 6 with the foot rest by a third joint 9. The seat 6 is fixed by a fourth joint 11 to the front support 1 which is extended to form seat frame support 1'. The backrest is by a fifth joint 10 fixed to the second or back support 2 which in the shown example of FIG. 5 is extended as second frame support 2.

The leg rest 7 is supported in the sitting and reclining position by a foot support 17 which is fixed with a joint 22 at the front support 1 or 1', and another joint 23 at the leg rest 7 at the respective lower end.

As a rule, the corresponding frame parts form, on both sides, the sitting and reclining area 4.

In the sitting position according to FIG. 4, the first, second, fourth and fifth joints 3, 8, 11 and 10, respectively, form, between the supports 1, 2 and the backrest 5 and seat 6, the four corner points of a quadrangle with the sides a, b, c and d, which are frame parts.

The joint 3 connecting the two supports 1 and 2 is located here above the lower joint 8 which represents the joint axis between the backrest 5 and seat 6.

In the mentioned quadrangle with the sides a, b, c and d the following condition applies:

$$a+b=n\cdot(c+d)$$

with $1.02 \leqq n \leqq 1.3$, preferably $1.05 \leqq n \leqq 1.15$.

Here the distance a lies between the first and fourth joints 11 and 3, respectively distance b between first and fifth joints 3 and 10, respectively distance c between the first and second joints 10 and 8, respectively and distance d between joints the second and fourth 8, respectively and 11.

The factor n is chosen so that a sensible distance results in the reclining position between the set-up surface 12 and reclining surface 4.

Since n is larger than 1 this automatically means that $$a+b>c+d.$$

In theory, the condition $$a+d=b+c$$

applies for the folded position.

In reality, however, the value for a+d is 3 to 5 mm shorter than for b+c, i.e. up to ca. 10%,* if the usual measurements for a+d are e.g. ca. 50 cm.

*Translator's note: error in German text. Given percentage does not correspond to given measurement.

It is useful that the ratio of distances a:b and c:d to the front and back support, in the case of the example shown of the front and back frame support 1' or 2', is chosen so that the joint 8 in the sitting position has at least the same distance from the set-up surface 12 than in the reclining position.

In the sitting position according to FIG. 2 the joints 11, 22, 23 and 9 (designated as the fourth, seventh, sixth and third joints, respectively); between the front frame support 1', the seat 6, leg rest 7 and foot support 17 also form the four corner points of another second quadrangle formed by sides e, f, g and h whereby the condition $$e+f=m\cdot(g+h)$$

applies for these sides or distances, with $1.15 \leqq m \leqq 1.50$, preferably $1.25 \leqq m \leqq 1.35$.

For this the distance e lies between the sixth and seventh joints 23 and 22, respectively, the distance f between the fourth and seventh joints 11 and 22, respectively the distance g between the fourth and third joints 11 and 9, respectively and the distance h between the third and sixth joints 9 and 23, respectively.

The factor m shall be chosen to the factor n in such a way that the horizontal reclining position can be obtained as easily as possible.

Even if overall only the conditions $$e+f>g+h \text{ (since } m>1)$$

and $$a+b>d+c \text{ (since } n>1)$$

must apply, the additional condition which specifies that $$a>c$$

$$b>d$$

and $$e>g$$

$$f>h$$

may also be fulfilled.

The latter conditions ensure a comfortable sitting position. But as long as the previously mentioned equations are fulfilled, a may equal c in individual cases or be slightly smaller as long as the total sum of a+b is larger than d+c. The same applies for e, f, g and h.

In the folded position the theoretical condition also applies for the other front quadrangle whereby $$e+h=g+f$$

must apply. In reality, these theoretical conditions might only be approximately fulfilled, as in the case of the middle quadrangle mentioned above.

Furthermore, the distances a+f form the front support 1 and the distances g+d form the seat 6.

FIGS. 4 through 6 show the chair-bed according to the invention in three different positions. To secure the sitting position, hinged levers 13 were located in a pivot point 14 at the back frame support 2' as a stop 49 for a sitting position whereby a connecting piece 15 which runs over the width of the piece of furniture connects the two hinged levers 13. If this hinged lever 13 is folded forward into the direction of the backrest then it supports the entire construction in the sitting position.

For safe catching of the hinged lever 13, a nose 16 is formed in the backrest 5 into which it may lock. A useful feature is that the connecting piece 15 is formed in such a way that it is placed sufficiently far away from the covered backrest 5 in the sitting position as well as in the reclining position of the chair-bed. This backrest is constructed in two parts and may be folded to the inside around joint 21. This is not mandatory, however, so that the backrest may also be constructed as one part so that the chair-bed in its entirety has only a three-part sitting and reclining surface 4.

Various sitting positions may also be obtained by locating several noses 16 in the backrest 5.

If the hinged lever 13 is folded backwards, the chair-bed is adjusted from the sitting to the reclining position. This is achieved by connecting the two quadrangles via the front support 1 and seat 6 and over their mutual joint 11.

The U-shaped back support 2 which in the example shown is also constructed as the bearing frame support 2', is, at its foot end, bent at an angle of 90° to a hook part 18. Through the hook part 18 runs an axle 19, whose ends each support a wheel 20 whose diameter corresponds to the height of the hook part.

This hook part 18 serves in the folded position of the chair-bed as a baggage carrier. For instance, bags or other baggage can be transported from the parking lot to the pool area whereby the wheels 20 permit easy movement and also move about effortlessly at the set-up place itself. The wheels may even be removed for transport. Finally, the wheels may be absent altogether.

The stop mechanism 49 may also have a hinged lever 13 which may, for example, be linked with the backrest 5, and is supported by the corresponding noses on the support 1. The stop 49 may also have a hinged lever 13 which may be folded and supported and which is, for example, located in the middle joint quadrangle with joints 3, 11, 8 and 10, or in the area of the front lower joint quadrangle with joints 23, 22, 11 and 9 and which in its locked position prevents the collapsing of the chair-bed in a pre-selected sitting position. Finally, it would even be possible to have a pivoting hinged lever as a stop 19 which is not supported between the various frame parts which are, because of the joints, adjustable relative to each other, but is supported only on one frame part against the ground, i.e. the set-up surface 12.

FIGS. 7 and 8 show a variation of the chair-bed according to the invention in three different positions whereby the important difference is that not the upper support 2 but the frame of the seat 6, i.e. the distance d, is extended into the back frame support 2'. It is possible in the example according to FIGS. 3 to 6 as well as in the example according to FIGS. 7 to 9 to construct support 2 or distance b as an arm rest.

As a stop 49 for securing the sitting position, a stirrup 24 is provided here and is in the example shown located at the backrest 5 at a corresponding joint whereby according to FIGS. 8 and 9 the joint 10 is also involved in the upper support 2. The stirrup 24 can rest against a peg 25 on the back frame support 2'. Several pegs and noses 25 may be provided for various sitting positions whereby the stirrup 24, similar to hinged lever 13, may also conversely be jointed to the extended frame support 2' and may rest against the backrest frame or may even be located at other parts of the joint mechanism.

In the last mentioned example the back frame support 2' must be equipped with a hook part since the reclining height results from the height of the hook part.

In order to provide stability the front frame support 1' may also be shaped like a stirrup.

Within the area of the backrest 5, seat 6 and leg rest 7, the cover of the chair-bed is anchored, which may consist of cloth, straps, upholstered materials or foil or similar materials.

The following refers to FIGS. 10 to 12 which show another example.

This example also varies essentially only through the difference in the back frame support 2'. In FIGS. 10 to 12 the upper support 2 is located between the upper joint 3 and joint 10 at the backrest, as in the example according to FIGS. 7 to 9. The back frame support 2' is, however, constructed neither as an extension of the support 2, which may also be formed as an arm rest 40, nor as an extension of the frame part of the seat 6. Rather, the joint support 2' is in this example fashioned as a separate support jointed to the upper joint quadrangle, which is formed by joints 3, 10, 8, and 11 at a suitable location and is provided with an additional guide 31 into which a corresponding peg slides which is attached at a different location of the joint quadrangle. In the example given the frame support 2' is also part of the upper joint 3 whereby the lower joint 8 which is located opposite the upper joint 3 is used as the peg sliding into the guide 31.

Through the guide 31 the back frame support 2' always remains in this way in connection with joints 3 and 8 formed by the upper support 2, which also represents the arm rest 40 and the front support 1, and by the backrest 5 and seat 6.

To adjust the sitting position, an additional stirrup 36 is located in joint 8 which may engage in hooks 37 at the back frame support 2'. In the sitting position the stirrup 36 prevents the loaded joint 9 from stretching apart into the reclining position. Stirrup 36 would not be necessary for the loading of joint 8 (see standard folding chairs). In the reclining position the stirrup 36 has the function of additional support for the backrest, for which purpose it runs across the entire width of the chair.

The joint 8 between backrest 5 and seat 6 is located in the folded position at the lower end 38 of the guide 31, i.e. in the direction of the set-up place, in the sitting position approximately at the center of the guide 31 and in the reclining position at the upper end 39 of the guide 31, i.e. in the direction of joint 3 between frame supports 1' and 2'. This shifting of the joint 8 in the guide 31 at the back frame support 2' also provides that the set-up base greatly increases between the sitting and reclining positions and is almost zero in the folded position.

For stability both frame supports 1' and 2' are U-shaped, as are the leg rest 7 and backrest. In order to maintain the distance, the joints 9 are connected with each other by a stabilizing bar (not shown). In order to avoid contact between the fabric when it is loaded and the stabilizing bar and stirrup 36, the latter are bent at right angles in the direction of the load.

Otherwise, the conditions and length ratios which were also mentioned in the previous examples apply to the distances a to d of the upper joint quadrangle and distances e to h of the front joint rectangle. Since in this example parts of the seat 6 and front support 1—which is also extended into joint support 1' here—are present in both quadrangles and are constructed as one part, this results in a simultaneous adjustment or changing of both quadrangles. Because, as described previously, the distances between the joints vary in length, this results in a change of the quadrangle in the reclining position into a triangle, since the angle between the seat 6 and leg rest 7 and the angle between the seat 6 and backrest 5 changes because of the flat reclining position to 180°. This then means that in the flat reclining position the joints 23, 9, 11, 8 and 10 lie on a straight line. In other words, the front joint quadrangle also turns into a triangle in the reclining position.

In the folded position the angles between seat 6, front support 1 or joint support 1', leg rest 7, foot support 17 and backrest 5 and arm rest 20 are also 180° which results in an overlapping of all frame parts.

FIGS. 13 to 15 show lateral views of another example to show that the back joint support 2' may, as already mentioned, also act on a different place in the upper quadrangle. In the example according to FIGS. 13 to 15 the back joint support 2' is additionally jointed in the lower area between backrest 5 and seat 6, more accurately in joint 8. The upper end of the joint support 2' runs in this case also inside a guide 31 by way of a peg or caster 41 running in it. Here the guide 31 is not located at the frame support 2' itself but at the upper support 2 which may also be constructed as an arm rest.

A securing of the sitting position in various seat positions is in this example, similar to the example in FIG. 8, also achieved with the help of a stirrup 24 which may be supported in corresponding noses or pegs 25 at the frame support 2'. It is again possible—as already explained in detail, to joint the support at the frame support 2' and to rest it against noses formed on the back of the backrest 5 or at another place. As seen from FIG. 15, the lowest peg 25 serves as an additional support in the horizontal reclining position.

In the example mentioned last the peg or caster 41 also only reaches the end of the guide 31 in the horizontal position according to FIG. 14. In contrast, in the sitting position the engaging part which is, for example, the caster 41 is approximately in the center of the guide 31, while the caster is located in the folded position at the end of the guide 31 which is on the opposite side from the location in the reclining position.

It is unnecessary to explain in further detail that the joints on each of the two sides are in the lateral view located flush to each other, i.e. on a mutual imagined axis line whereby all axes in the example given are horizontal and parallel to each other.

In conclusion, it is also remarked that it is not necessary for the individual joints themselves, for example, joints 9, 11, 8, 10, to be located on the same horizontal plane, even if the horizontal reclining position has otherwise been set. Only the individual frame parts or frame part sections c, d and g, h must in the horizontal position be actually horizontal to form the reclining surface, while the joints may in contrast be set off from this horizontal area. This is, for example, the case when the individual frame parts are equipped with right-angled bends in the joint areas. For instance, in FIG. 3 the joint 8 could lie between the frame parts c and d above the horizontal reclining surface 4 if frame sections are constructed which are bent at right angles and protrude to the top and over the horizontal reclining surface 4 on which the joint 8 is elevated. The expression chosen in the Claims "Length of frame parts a, b . . . " thus indicates mainly the sections and sides lying within the extension of the individual frame parts. For instance, in the drawing according to FIG. 9 the joint axis 8 may lie even much higher above the horizontal reclining surface 4 if the right-angled bends at frame parts c and d are still larger. The "actual" distance between joint axis 11 and 8 would then correspond to the hypotenuse in a right-angled triangle, formed by cathetus d, i.e. the actual frame part forming the horizontal position, and another cathetus which corresponds to the height between joint 8 and horizontal reclining surface 4. These right-angled bends are therefore only variations so that the invention concept of this application is not relinquished.

Similar bent support bars which result only in slightly changed kinematics without forsaking the protected context of the application may, for example, be used for the frame supports 1' and 2', supports 1 and 2 and other parts of the chair-bed.

I claim:

1. A convertible chair-bed comprising:

first and second supports pivotally connected one to the other at adjoining ends to form a first joint;

a sitting and reclining surface including a backrest, a seat and a leg rest each having opposite end edges, said seat being pivotally coupled to an adjoining end edge of said backrest to form a second joint and to an adjoining end edge of said leg rest to form a third joint spaced from said second joint;

means for pivotally coupling said seat and said first support to define a fourth joint at a location along said seat intermediate said second and third joints and spaced along said first support from said first joint;

means for pivotally coupling said backrest and said second support to define a fifth joint at a location along said backrest spaced from said second joint and along said second support spaced from said first joint;

said first, second, fourth and fifth joints forming the end joints of a first quadrangle meeting the condition $$a+b>c+d$$

wherein a is the distance between said first and fourth joints, b is the distance between said first and fifth joints, c is the distance between said fifth and second joints, and d is the distance between said second and fourth joints;

a foot support connected to said leg rest to define a sixth joint at a location along said leg rest spaced from said third joint and to said first support to define a seventh joint at a location spaced from said fourth joint and along the opposite side thereof from said first joint;

said third, fourth, sixth and seventh joints forming the end points of a second quadrangle meeting the condition $$e+f>g+h$$

wherein e is the distance between said sixth and seventh joints, f is the distance between said fourth and seventh joints, g is the distance between said third and fourth joints and h is the distance between said third and sixth joints;

seat and back support members coupled to said seat and backrest, respectively, for changing said chair-bed from a sitting position to a reclining position and vice versa in response to movement of either member.

2. A chair-bed according to claim 1 wherein the following condition applies for the distances a, b, c and d:

$$a+b=n\times(c+d)$$

with $1.02 \leqq n \leqq 1.3$.

3. A chair-bed according to claim 1 wherein the following condition applies for the distances e, f, g and h:

$$e+f=m\times(g+h)$$

with $1.15 \leqq m \leqq 1.5$.

4. A chair-bed according to claim 1 wherein said back-rest and said leg rest may be pivoted about said seat to obtain a folded position wherein the distances a, b, c and d of said first quadrangle and the distances e, f, g and h of said second quadrangle at least approximate the condition:

$$a+d=b+c$$

and $$e+h=g+f.$$

5. A chair-bed according to claim 4 wherein the sum of the distances a+b varies from the sum of the distances b+c and the sum of the distances e+h varies from the sum of the distances g+h each by up to 5 millimeters.

6. A chair-bed according to claim 1 wherein said seat support member forms a part and a continuation of said first support.

7. A chair-bed according to claim 1 wherein said back support member extends from said fifth joint as a continuation of said second support and on the side of said fifth joint remote from said first joint.

8. A chair-bed according to claim 1 wherein said back support member extends from said second joint as an extension of said seat and on the side of said second joint remote from said fourth joint.

9. A chair-bed according to claim 8 including a hook part extending downwardly and forming part of said back support member.

10. A chair-bed according to claim 8 including wheels attached to said back support member.

11. A chair-bed according to claim 10 wherein said hook part carries an axle, said wheels being carried on said axle and having a diameter corresponding to the height of said hook part.

12. A chair-bed according to claim 1 wherein said back support member is coupled to at least one of the joints of said first quadrangle, a guide for guiding said back support member, and means coupled to said second joint for guiding said guide for movement thereof relative to said seat and said backrest.

13. A chair-bed according to claim 12 wherein said guide comprises said back support member, a peg at said second joint connecting the seat and the backrest, said peg extending into said guide, the upper end of said back support member being joined to said first and second supports at said first joint.

14. A chair-bed according to claim 12, including a stirrup disposed adjacent said second joint between said backrest and said seat, hooks carried by said back support member and engageable in said stirrup for maintaining said chair-bed in said sitting position.

15. A chair-bed according to claim 14 wherein said second joint is carried for sliding movement in the guide whereby said stirrup supports the backrest against said back support member in said reclining position.

16. A chair-bed according to claim 1 wherein said second support comprises an arm rest, a guide carried by said second support, an upper end of said back support member having an element engaging and movable along said guide, said back support member being joined to said second joint.

17. A chair-bed according to claim 1, including a stop for securing said seat and backrest in said sitting position.

18. A chair-bed according to claim 17 wherein said stop comprises a hinged lever cooperable between said back support member and said backrest, said lever being hinged on one end to one of said backrest and said back support member and an abutment carried by the other of said backrest and said back support member for engaging the opposite end of said lever.

19. A chair-bed according to claim 18 including a pair of said hinged levers located on opposite sides of the chair-bed and coupled to one another by a connecting piece.

20. A chair-bed according to claim 1 wherein said back support member is coupled to at least one of said joints of said first quadrangle, a guide for guiding said back support member and comprising a part of said second support, and a peg carried by an end of said back support member for engaging said guide intermediate its opposite ends in the sitting position of said chair-bed and engaging said guide at one end thereof in the reclining position.

* * * * *